US010801301B2

(12) United States Patent
Carragher et al.

(10) Patent No.: US 10,801,301 B2
(45) **Date of Patent: *Oct. 13, 2020**

(54) RELEASABLE ALLOY SYSTEM AND METHOD FOR WELL MANAGEMENT

(71) Applicant: BiSN Tec Ltd., Birchwood, Warrington (GB)

(72) Inventors: Paul Carragher, Cheshire (GB); Leo Richards, Merseyside (GB)

(73) Assignee: BiSN Tec Ltd, Cheshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/450,761

(22) Filed: Jun. 24, 2019

(65) Prior Publication Data

US 2020/0011150 A1 Jan. 9, 2020

Related U.S. Application Data

(60) Continuation of application No. 16/104,930, filed on Aug. 19, 2018, now Pat. No. 10,329,872, which is a (Continued)

(30) Foreign Application Priority Data

Jun. 4, 2010 (GB) ..... 1009378.9

(51) Int. Cl.
*E21B 33/13* (2006.01)
*E21B 23/00* (2006.01)
(Continued)

(52) U.S. Cl.
CPC ..... *E21B 33/13* (2013.01); *E21B 23/00* (2013.01); *E21B 33/12* (2013.01); *E21B 33/134* (2013.01); *E21B 33/138* (2013.01); *E21B 36/00* (2013.01)

(58) Field of Classification Search
CPC ..... E21B 33/13; E21B 23/00
(Continued)

(56) References Cited

U.S. PATENT DOCUMENTS 1,534,229 A 4/1925 Livergood
2,076,308 A 4/1937 Wells
(Continued)

FOREIGN PATENT DOCUMENTS

CA 2592556 6/2007
EP 1 933 004 6/2008
(Continued)

OTHER PUBLICATIONS

U.S. Appl. No. 16/095,928, filed Oct. 23, 2018, Carragher.
(Continued)

*Primary Examiner* — Catherine Loikith
*Assistant Examiner* — Ashish K Varma
(74) *Attorney, Agent, or Firm* — Glen P. Belvis; Belvis Law, LLC.

(57) ABSTRACT

Apparatus, in the form of a eutectic alloy plug (1) and a deployment heater (10) are provided. The plug (1) and the deployment heated (10) are provided with means (5, 13) for releasably retaining the deployment heater (10) within a cavity (4) in the plug (1). The nature of the retaining means is such that once the plug (1) is secured in a well the heater (10) can be recovered without the plug (1). An extraction heater (20), which is also receivable within the cavity (4) of the plug (1), is provided to re-melt the eutectic alloy and thus enable the extraction of the plug from a well. Various method of plugging abandoned wells are made possible by the control that the provided apparatus gives.

7 Claims, 14 Drawing Sheets

Related U.S. Application Data continuation of application No. 15/648,277, filed on Jul. 12, 2017, now Pat. No. 10,053,951, which is a division of application No. 13/702,049, filed as application No. PCT/EP2011/058776 on May 27, 2011, now Pat. No. 9,708,882.

(51) Int. Cl.

| | |
|---|---|
| ***E21B 33/12*** | (2006.01) |
| ***E21B 33/134*** | (2006.01) |
| ***E21B 33/138*** | (2006.01) |
| ***E21B 36/00*** | (2006.01) |

(58) Field of Classification Search
USPC ..... 166/288
See application file for complete search history.

(56) References Cited

U.S. PATENT DOCUMENTS

| | | | |
|---|---|---|---|
| 2,686,689 | A | 8/1954 | Douglas |
| 2,789,004 | A | 4/1957 | Forster |
| 2,822,876 | A | 2/1958 | Murrow |
| 3,119,451 | A | 1/1964 | Hall |
| 3,170,516 | A | 2/1965 | Corley |
| 3,208,530 | A | 9/1965 | Allen |
| 3,871,315 | A | 3/1975 | Anderson |
| 4,134,452 | A | 1/1979 | Kingelin |
| 4,423,783 | A | 1/1984 | Haag |
| 4,488,747 | A | 12/1984 | Austin |
| 4,523,640 | A | 6/1985 | Wilson |
| 4,696,343 | A | 9/1987 | Anderson |
| 5,052,489 | A | 10/1991 | Carisella |
| 5,564,861 | A | 10/1996 | Khudenko |
| 6,102,120 | A | 8/2000 | Chen |
| 6,454,001 | B1 | 9/2002 | Thompson |
| 6,474,414 | B1 | 11/2002 | Gonzalez |
| 6,664,522 | B2 | 12/2003 | Spencer |
| 6,828,531 | B2 | 12/2004 | Spencer |
| 6,923,263 | B2 | 8/2005 | Edin |
| 7,152,657 | B2 | 12/2006 | Bosma |
| 7,290,609 | B2 | 11/2007 | Wardlaw |
| 2002/0162596 | A1 | 4/2002 | Simpson |
| 2002/0056553 | A1 | 5/2002 | Duhon |
| 2003/0132224 | A1* | 7/2003 | Spencer ..... E21B 33/13 219/635 |
| 2004/0261994 | A1 | 12/2004 | Nguyen |
| 2005/0109511 | A1 | 5/2005 | Spencer |
| 2006/0144591 | A1 | 7/2006 | Gonzalez |
| 2007/0051514 | A1 | 3/2007 | La Rovere |
| 2010/0006289 | A1 | 1/2010 | Spencer |
| 2010/0263876 | A1 | 10/2010 | Frazier |
| 2011/0132223 | A1 | 6/2011 | Streibich |
| 2011/0146519 | A1 | 6/2011 | Han |
| 2011/0174484 | A1 | 7/2011 | Wright |
| 2011/0214855 | A1 | 9/2011 | Hart |
| 2012/0199351 | A1 | 8/2012 | Robertson |
| 2012/0298359 | A1 | 11/2012 | Eden |
| 2013/0087335 | A1 | 4/2013 | Carraher |
| 2013/0192833 | A1 | 8/2013 | Gano |
| 2014/0318782 | A1 | 10/2014 | Bourque |
| 2015/0211326 | A1 | 7/2015 | Lowry |
| 2015/0211327 | A1 | 7/2015 | Lowry |
| 2015/0211328 | A1 | 7/2015 | Lowry |
| 2015/0345248 | A1 | 12/2015 | Carragher |
| 2015/0368542 | A1 | 12/2015 | Carragher |
| 2016/0145962 | A1 | 5/2016 | Carragher |
| 2016/0319633 | A1 | 11/2016 | Cooper |
| 2017/0030162 | A1 | 2/2017 | Carragher |
| 2017/0089168 | A1 | 3/2017 | Carragher |
| 2017/0226819 | A1 | 8/2017 | Carragher |
| 2017/0234093 | A1 | 8/2017 | Carragher |
| 2017/0234100 | A1 | 8/2017 | Carragher |
| 2017/0306717 | A1 | 10/2017 | Carragher |
| 2019/0085659 | A1 | 3/2019 | Carragher |
| 2019/0014355 | A1 | 5/2019 | Carragher |
| 2019/0186230 | A1 | 6/2019 | Carragher |

FOREIGN PATENT DOCUMENTS

| | | |
|---|---|---|
| GB | 2016063 | 9/1979 |
| GB | 2 164 886 | 4/1986 |
| WO | WO 2011/151171 | 12/2011 |
| WO | WO 2013/066340 | 5/2013 |

OTHER PUBLICATIONS

U.S. Appl. No. 16/589,012, filed Sep. 30, 2019, Carragher.
U.S. Appl. No. 16/616,456, filed Nov. 26, 2019, Carraher.
Dec. 8, 2011, PCT, PCT/EP2011/058776 Search Rpt and Opinion.

* cited by examiner

RELEASABLE ALLOY SYSTEM AND METHOD FOR WELL MANAGEMENT

This application is a continuation of Ser. No. 16/104,930 filed Aug. 19, 2018, which is a continuation of Ser. No. 15/648,277 filed Jul. 12, 2017, which is a divisional of Ser. No. 13/702,049 filed Dec. 4, 2012, and which is a national stage entry of PCT/EP2011/058776 filed May 2, 2011, the entire disclosures of each of which are incorporated herein by reference.

FIELD OF THE INVENTION

The present invention relates to the plugging of wells, and in particular oil and gas wells. More particularly the present invention relates to methods and apparatus for use in the plugging of wells.

BACKGROUND OF THE INVENTION

When a well, such as an oil or gas well, is at the end of its useful life it is usually abandoned. However before a well can be abandoned the well must be "plugged" to ensure that potentially hazardous materials, such as hydrocarbons, cannot escape the well.

In the past various methods have been employed to plug abandoned wells. One such known method involves pouring cement or resin into a well so as to fill a length of the well. However the use of cement/resin has proven to be unreliable and vulnerable to leaking. This can lead to previously abandoned wells being re-plugged at considerable extra expense.

In view of the limitations of using cement/resin to plug wells an alternative approach was developed which uses a bismuth-containing alloy to form a seal within the well. This approach, which is described in detail in CA 2592556 and U.S. Pat. No. 6,923,263, makes use of the fact that such alloys contract upon melting and expand again when they re-solidify. Essentially the alloy is deployed into a well; heated until it melts and "slumps"; and then allowed to cool whereby the alloy expands to form a tight seal with the walls of the well.

The use of eutectic alloys, such as bismuth-containing alloys, to plug wells or repair existing plugs in wells is described in: U.S. Pat. Nos. 7,290,609; 7,152,657; US 2006/0144591: U.S. Pat. Nos. 6,828,531; 6,664,522; 6,474,414; and US 2005/0109511.

SUMMARY OF THE INVENTION

The present invention seeks to provide improved apparatus for use in the plugging of abandoned wells. Specifically the present invention provides a plug and a heater, which come together to form a plug/heater assembly that can be used to deploy a plug within a well. The interaction of the apparatus of the present invention is such that once the plug has been deployed the heater can be recovered from the well.

Of the above identified patents, only CA 2592556; U.S. Pat. Nos. 6,923,263; 7,290,609; and US 2006/0144591 describe the use of a eutectic alloy plug/heater assembly to deploy a plug within a well. However, both U.S. Pat. No. 7,290,609 and US 2006/0144591 are only suitable for repairing existing plugs that have failed, unlike the apparatus of the present invention. Also the heater of the tool of U.S. Pat. No. 6,923,263 is not releasable and therefore cannot conveniently be recovered from the well. Of the identified prior art only CA 2592556 describes a tool wherein the heater can be released from the rest of the tool and subsequently recovered, although the details of the mechanism by which this is achieved are lacking.

The releasable connection formed between the plug and the heater aspects of the present invention allows the plug/heater assembly to be deployed into a well a single tool, which removes the need to align the plug and the heater up within the well. By making the connection between the plug and heater releasable it is possible to extract the heater from the well once the plug is secured in place. This provides considerable cost savings by enabling a heater to be re-used multiple times.

Preferred features of the plug of the present invention will now be identified. Preferably the plug may have means for releasably retaining heating means that operate by way of a mechanical interaction with said heating means. The means for releasably retaining heating means may comprise at least one recess in the walls of the plug body cavity. Alternatively the means for releasably retaining heating means may comprise at least one resiliency biased projection on the walls of the plug body cavity.

Preferably the means for receiving a eutectic alloy receives the eutectic alloy on the outside of the plug body. It is also preferable that the means for receiving a eutectic alloy receives the alloy in close proximity to the portion of the cavity that receives a heating means.

Advantageously the plug may further comprise a eutectic alloy. The alloy is received by the means for receiving the eutectic alloy.

Preferably the plug may comprise a tapered head to aid insertion of the plug into the plug body cavity of an adjacent plug. It is also preferable that the plug may comprise means for retaining the plug within the plug body cavity of an adjacent plug. In this way multiple plugs can be stacked within a well.

Preferably the plug may comprise means for retaining extraction means within the cavity of the plug body. This enables the plug to be recovered from a well at a later date using extraction means.

In one aspect of the present invention the plug preferably further comprises: a piston-like member that fits tightly within the well; and a collar slideably mounted on the outside of the plug, said collar having a semi-permeable portion, which in use, is located adjacent to the well wall. The plug of this aspect of the invention is considered particularly useful for the plugging of wells that have a more horizontal orientation.

Further preferably the means for receiving the eutectic alloy may receive the eutectic alloy between the piston-like member and the collar on the outside of the plug. It is also preferable that the semi-permeable portion may be a wire mesh.

Preferably the plug may further comprise a leading head in the form of an open ended cylinder, wherein the cylinder is open at the leading face, in this way cooling water from within the well may enter to cylinder, thereby cooling the cylinder and the molten alloy as it drips down the plug.

Further preferably the cylinder comprises a plurality of holes to allow the flow of fluids in and out of the cylinder, in this way the water is free to flow in and out of the cylinder.

Also this arrangement allows gases, which might otherwise become trapped in the cylinder as it descends into a well, to escape. To this end at least some of said plurality of holes may be located towards the opposite end of the cylinder to the main opening at the leading face of the cylinder.

Preferably the cylinder may be tapered at the leading end to aid deployment of the plug down a well.

Preferably the leading head may further comprise one or more wire meshes or brushes arranged on the external surface of the cylinder. In this way the movement of the melted alloy down the sides of the plug is impeded so that it has more time to cool and solidify before it can drip off the end of the plug.

Also it is appreciated that the use of wire meshes or brushes is particularly advantageous as they are flexible and as such do not impede the deployment of the plug down a well. In addition the wire meshes or brushes can also be arranged to provide a cleaning function on the well casing as the plug is deployed.

Preferred features of the heater of the present invention will now be identified. Preferably the heat source may be located on the portion of the heater body that is receivable within a plug body cavity. It is appreciated that the exact location of the heat source can vary depend on the task for which the heater is being used, be it plug deployment or plug extraction.

Preferably the heater may have means for retaining a plug that operate by way of a mechanical interaction within the plug cavity of a plug. Preferably the means for retaining the heater within a plug body cavity may comprise at least one resiliency biased projection. Alternatively the means for retaining the heater within a plug body cavity comprise at least one recess in the heater body.

In one aspect of the present invention it is preferable that the above mentioned mechanical interactions releasably connect the plug and the heater. Alternatively, in another aspect of the present invention it is preferable that the means for retaining the heater within a plug body cavity may comprise a latch. This is considered most applicable when using the heater of the present invention to extract a plug from within a well, Preferably the portion of the heater body that is received within a plug body cavity may further comprise a tapered head to aid insertion of the heater body into a plug body cavity, Again this feature is considered useful when the heater of the present invention is subsequently inserted in to a well to recover an existing plug from the well.

In yet another aspect of the heater of the present invention the heater may further comprise means for receiving a eutectic alloy. By providing means to store additional eutectic alloy on the heater itself, it is possible to more quickly deploy an increased amount of alloy at a plug site without having to remove the heater and deploy an additional plug.

Advantageously the means for receiving a eutectic alloy may further comprise a release mechanism. Further advantageously the release mechanism may be actuated when the heater is received within a plug body cavity. This arrangement facilitates the subsequent delivery of eutectic alloy to a plug that is already in-situ within a well without the need for a second plug.

In addition to the above identified apparatus the present invention provides various methods of both deploying plugs in wells and recovering plugs from wells. The improved control of the deployment and recovery of the plug and heater not only facilitates improved methods of plugging wells that have varying orientations, but also addresses the squeezing off well perforations.

In one aspect of the present invention a method of deploying eutectic alloy plugs into wells to plug them is provided in accordance with deploying a plug within a well, in particular a gas or oil well, said method including: forming a plug/heater assembly by inserting a heater into a plug body cavity; providing the assembly with eutectic alloy; attaching the assembly to a delivery tool before lowering said assembly down a well; activating the heater to melt the provided eutectic alloy so that the alloy slumps and forms a seal between the plug and the walls of the well; allowing the eutectic alloy to cool before retrieving the heater from the well using the delivery tool. Preferably the method uses the apparatus of the present invention.

In another aspect of the present invention a method of squeezing off well perforations is provided according to squeezing off perforations in a well, in particular a gas or oil well, wherein said method induces repeating the method steps of the preceding paragraph a plurality of times whilst maintaining pressure down the well to squeeze the alloy into the perforations. Preferably this method uses the apparatus of the present invention.

In a further aspect of the present invention a method of retrieving existing plugs from within a well is provided in accordance with using the plugs of the preceding paragraphs and/or the heater of the preceding paragraphs in accordance with the methods of the two directly preceding paragraphs.

In a yet further aspect of the present invention a method of deploying a eutectic alloy plug within a well that has a substantially non-vertical orientation is provided.

BRIEF DESCRIPTION OF THE DRAWINGS

The various aspects of the present invention will now be described with reference to the drawings, wherein.

DETAILED DESCRIPTION OF THE VARIOUS ASPECTS OF THE PRESENT INVENTION

The general principle of the present invention is the provision of apparatus for both deploying and recovering eutectic alloy plugs, such as Bismuth plugs, into and out of wells of various types and orientations.

By providing a plug and a deployment heater that are releasably connectable to one another the present invention enables a plug/heater assembly to be used to deploy a plug without having to abandon both the plug and the heater within the well—this has obvious cost savings.

By providing an extraction heater that is non-releasably connectable to that same plug which is inserted in a well using the deployment heater, the present invention enables previously abandoned wells to be reopened without the need for drilling or explosive devices.

Although the present invention identifies additional technical features that provide further utility to the apparatus of the present invention, it is the interactions between the deployment and extraction heaters and the plug which provide the level of in-situ control that makes the methods of the present invention practicable.

Figure 1:
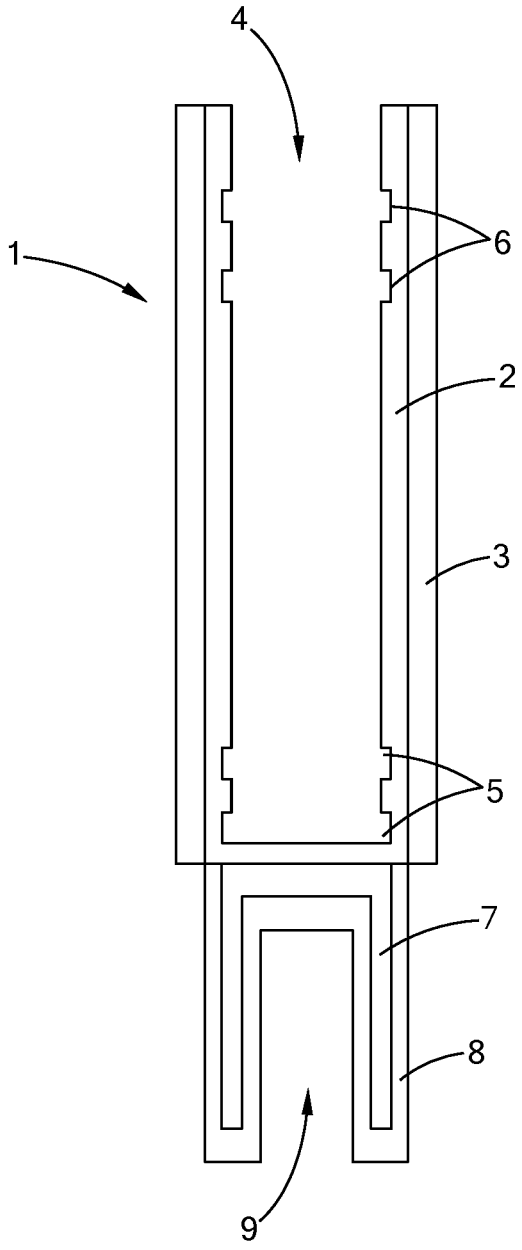
FIG. 1 shows, in cross section, a recoverable plug of the present invention.

FIG. 1 shows a preferred embodiment of the extractable plug 1 of the present invention. The plug 1 has a body 2 that is preferably made from a metallic materials such as steel so that heat can transferred through the body to the eutectic alloy 3, which is received on the outside of plug 1.

The plug body 2 has a cavity 4 the dimensions of which allow the insertion of a heater like the one shown in FIG. 2, (or even another plug—described below).

Means 5 for releasably retaining a heater are located within the cavity 4 of the plug. In the embodiment of FIG. 1 the means 5 comprise one or more recesses in the inner walls of the plug body 2. Such recesses 5 are shaped receive the heater's own means for releasably retaining the plug, which will be described later. It is appreciated in alternative arrangement of the present invention the releasable retaining means of the heater and the plug could be switched, i.e. the heater has the recesses.

Means 6, in the form of recesses, for retaining an extraction heater are also located within the cavity 4 of the plug 1, The role of means 6 and their relationship with the extraction heater will be described in more detail below.

Although provided by separate recesses in the preferred embodiment it is appreciated that both the means for releasably retaining a heater 5 and the means for retaining an extraction heater 6 could be provided by the same recesses.

The leading end of the plug 1 is provided with a cylindrical body 7 with an internal cavity 9. The cylindrical body 7, which is preferably made of steel, is covered in a layer 8 of un-reactive material such as pure bismuth. Because the cylindrical body 7 is cooler than the region of the plug housing the heater the molten eutectic alloy can freeze as it runs down the cylindrical body 7. The un-reactive layer 8 is provided to protect the cylindrical body, which is preferably made from steel, from eroded by acidic gases such as hydrogen sulphide and carbon dioxide, which can be present within some wells.

Figure 2:
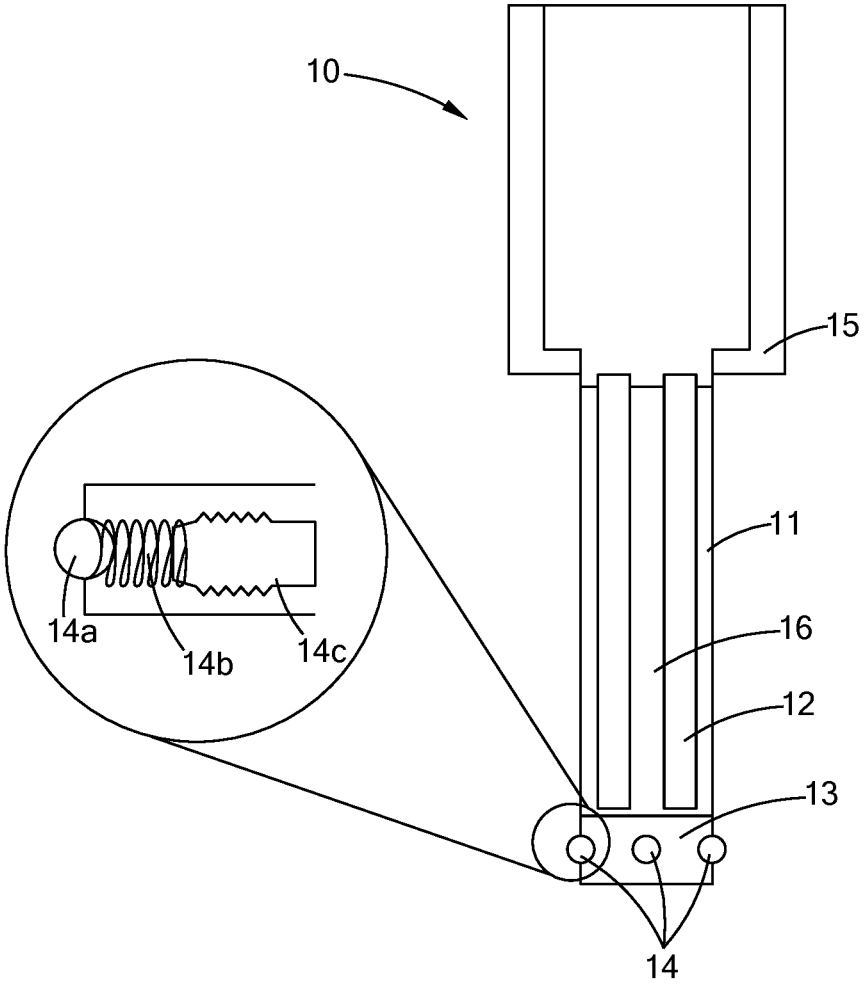
FIG. 2 shows, in cross section, a heater for deploying the plug of the present invention within a well.

FIG. 2 shows a preferred embodiment of a plug deployment heater 10 of the present invention. A portion 11 of the heater 10 is shaped so as to enable the heater 10 to be received within the cavity 4 of the plug 1. The heater 10 is provided with a heat source 12 that is capable of generating sufficient heat energy to melt the eutectic alloy (e.g. Bismuth alloy) used in the various embodiments of the present invention. The heat source 12 may be provided using electrical cartridge heaters, but it is submitted that suitable alternative heater, including electrical and chemical types, will be appreciated.

The positioning of the heat source 12 within the heater 10 is such that any heat generated is directed mainly towards the sides of the heater 10 and thus the plug 1. Zinc 16, which has efficient heat transferring qualities, is arranged around the heat source to help focus the direction of the heat from the internal heat source 12. In this way the heat is focused on melting the eutectic alloy 3 that is received on the outside of the plug 1, whilst at the same time allowing the already melted alloy to cool and re-set once it has slumped away from the area of focus. It is submitted that alternatives to zinc will be apparent upon consideration of the present invention.

The end of the heater 10 is provided with means 13 for releasably retaining the heater 10 within the cavity 4 of the plug 1. Such means 13 comprise a plurality of resiliency biased ball bearings 14 that, whist being held captive in housings, stand proud of the means 13.

When the heater 10 is inserted into the cavity 4 of the plug 1 the ball bearings 14 are forced into their housings so that the heater portion 11 can fit into the cavity 4. Once the heater is fully inserted into the plug 1 the ball bearings 14 are able to return to their default position, whereby they are received in the one or more recesses 5 of the plug 1.

As is shown in the highlighted view of the ball bearings, the retaining means 13 have a plurality of recesses each having an opening that is smaller in diameter than the ball bearing 14*a* so that the ball bearing in trapped. A spring 14*b*, which is attached to a grub screw 14*c* within the recess, acts to push the ball bearing 14*a* towards the opening. This arrangement enables the ball bearing 14*a* to sink into the recess when adequate pressure is applied to the proud portion of the ball bearing 14*a*.

The interaction of the ball bearings 14 with the one or more recesses 5 of the plug provides a connection which is strong enough to ensure the plug 1 remains attached to the heater 10 as it is deployed in to a well. However, because of the nature interaction formed between the ball bearings 14 and the one or more recesses 5, the heater 10 can be detached from the plug 1 once the plug is sufficiently anchored in position by the re-set eutectic alloy.

Alternative mechanisms for providing the means for releasably retaining the heater in the plug body cavity are appreciated. One such alternative means comprises a sheer pin that retains the heater in position until a suitable extraction force is applied to sheer the pin and thereby release the heater.

Another alternative means uses a resin based seal that breaks under a sufficient extraction force.

The heater 10 is also provided with a means 15 for attaching it to a delivery tool such as a cable and winch (or wireline) for example. In this way the heater 10 and the plug 1 can be delivered to a desired target in a well with a high level of control and accuracy. It is anticipated that the skilled person will appreciate suitable mechanisms for attaching the heater to a suitable deployment tool.

Figure 3:
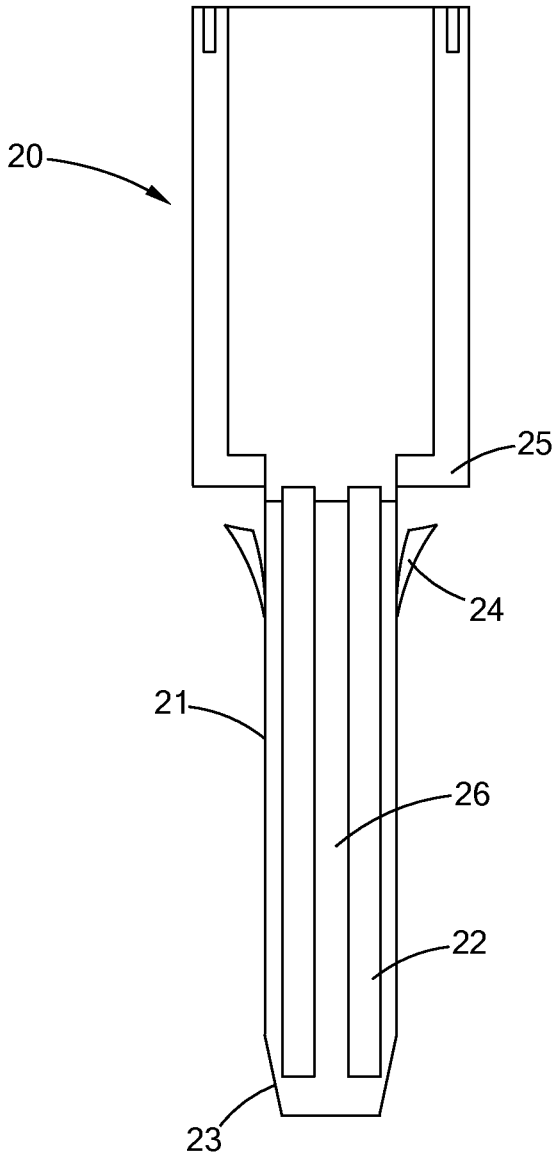
FIG. 3 shows, in cross section, a heater for recovering a plug of the present invention from within a well.

FIG. 3 shows a preferred embodiment of the extraction heater 20 of the present invention. As with the deployment heater 10, a portion 21 of the extraction heater 20 is shaped so as to enable the heater 20 to be received within the cavity 4 of the plug 1.

Once again the heater's heat source 22 is located within the portion 21 of the extraction heater that is received within the cavity 4. However the arrangement of the heat source 22 is such that the heat is directed downwards towards the eutectic alloy that seals the plug in-situ within the well. Once again zinc 26 for its heat transferring ability which helps focus and direct the heat from the heat source towards the eutectic alloy.

Unlike the deployment heater 10, the extraction heater 20 is not delivered down a well with the plug 1. Instead the extraction heater must be delivered down a well and inserted into the cavity 4 of the plug 1. In order to assist the docking of the extraction heater 20 within the cavity 4 of the plug 1, the portion 21 is provided with a tapered end 23, In order to enable the extraction heater 20 recover the plug 1 from a well once the eutectic alloy has been melted by the heater 20, a latching mechanism 24 is provided on the heater portion 21. The latching mechanism 24, which is resiliency biased, is pressed in when the heater portion 21 is inserted into the cavity of the plug 1. Once the latching mechanism 24 aligns with the plug's one or more recesses 6 the latching mechanism 24 locks the extraction heater and the plug together.

As with the deployment heater 10, the extraction heater 20 is provided with means to enable the heater to be attached to a delivery tool such as a cable and winch. Various forms of delivery tool are contemplated without departing from the general concept of the present invention.

Figure 4A:
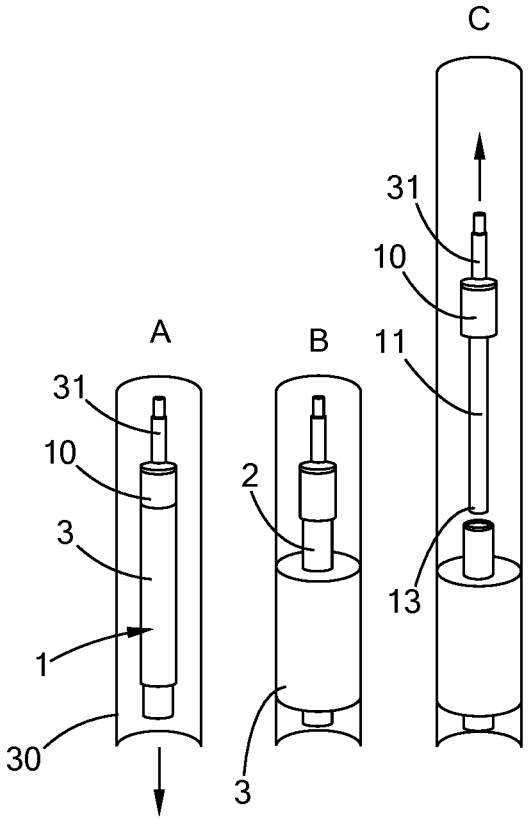
FIG. 4*a* shows the stages involved in the deployment of a plug of the present invention.
Figure 4B:
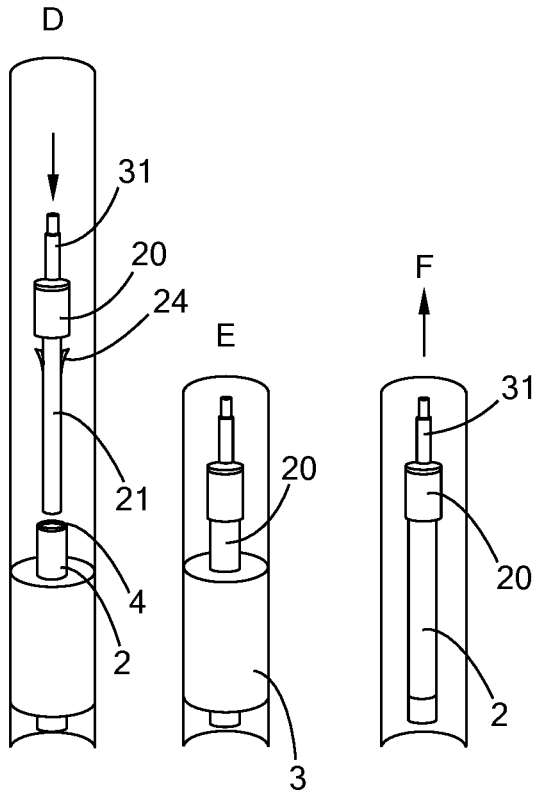
FIG. 4*b* shows the stages involved in the recovery of a plug of the present invention.

FIGS. 4*a* and 4*b* show the stages involved first in the deployment (A, B & C); and second in the recovery (D, E & F) of a plug 1 of the present invention within a well 30.

Firstly the plug 1 and the heater 10 are connected together to form an assembly. Then using a delivery too!$_s$ the head of which 31 is attached to the heater using the previously mentioned means 15, the heater/plug assembly is inserted into the well mouth and delivered to its target (i.e. the location where the plug is to be fitted), as shown in step A.

Once the assembly is in the desired location the heat source of the heater is activated, it is appreciated that there are various ways of activating the heat source. In one preferred method the wireline that is used to deliver the heater into a well can also be used to send the activation signal to an electric heater. Alternatively the activation wire could be run parallel to the wireline in tubing. In situations where a chemical heater is used the wireline could be used to activate the fuse/starter.

Once the heat source has been activated the eutectic alloy 3 on the plug begins to melt. As the alloy melts it tends to slump downwards. As the alloy moves out of close proximity of the heat source it starts to cool again and solidify. The cooling of the alloy is also aided by temperatures within the well. The presence of water within the well, which is not unusual given the techniques employed to extract oil from the ground, also contributes to the quick cooling of the alloy.

It will be appreciated that, due to the physical properties of eutectic alloys, as the alloys cool and solidify they expand. By heating the alloy and then allowing it to cool a seal is formed between the plug body 2 and the well wall thereby plugging the well 30. The alloy is usually heated for between 1-2 hours with an electric heater, or between 1-2 minutes with a chemical heater.

Once the heat source is turned off the alloy is given time to cool, which enables the solidification of the alloy in the areas that was previously being heated. This process enables more of the plug body 2 to be secured in place with the alloy 3, as shown in step B. Due to the environment within the well it is appreciated that the cooling time of the alloy is fairly short. However to ensure the alloy is adequately solidified and the seal strong the heater can be left for a couple of hours after the heating stops before any extraction of the heater is attempted.

Once the alloy has been given adequate time to cool and solidify the delivery tool can be engaged to retrieve the heater 10 from the well 30, as shown in step C. The strength with which the plug is fixed in position within the well by the expanded alloy is greater than the strength of the connection formed between the heater 10 and the plug 1 by the releasable retaining means (13 and 5 respectively). Because the plug 1 is more tightly held within the well than it is to the heater 10, the delivery tool only retrieves the heater 10 from the well 30.

If, for whatever reason, it becomes necessary to recover the plug 1 from a well 30, the process of retrieving the plug 1 of the present invention is straight forward and does not require heavy drilling equipment or explosives. Instead the present invention provides an extraction heater 20 which, like the deployment heater 10, can be attached to a delivery tool and delivered to the target location within the well, as shown in step D.

The heater 20 has a portion 21 with a tapered end. This tapered end assists in guiding the heater 20 into the cavity 4 of the plug 1. The heater portion 21 has a latch mechanism 24, which engages with recesses within the cavity 4 to secure the heater to the plug, as shown in step E.

Once the heater 20 is in place the heat source can be activated in a similar way as already mentioned. As has already been described the heat source of the extraction heater 20 is arranged to focus the heat downwards rather than sideward. In this way the eutectic alloy 3 that is holding the plug 1 in place can be heated and melted. Once the alloy has been suitably melted the delivery tool can be engaged to extract the heater/plug assembly from the well, as shown in step F.

Although using a central plug body in combination with the eutectic alloy does reduce the amount of alloy needed to plug a well, there are situations where more alloy is required than can be practically received on a single plug body. One such situation is when squeezing off well perforations in the: well wails and/or well casing. Welt-perforations are holes that are punched in the casing of a well to connect the well to a reservoir, of oil for example. When abandoning all, or even just part, of a well it is considered preferable to squeeze off depleted perforations to prevent leakage and contamination.

Figure 5:
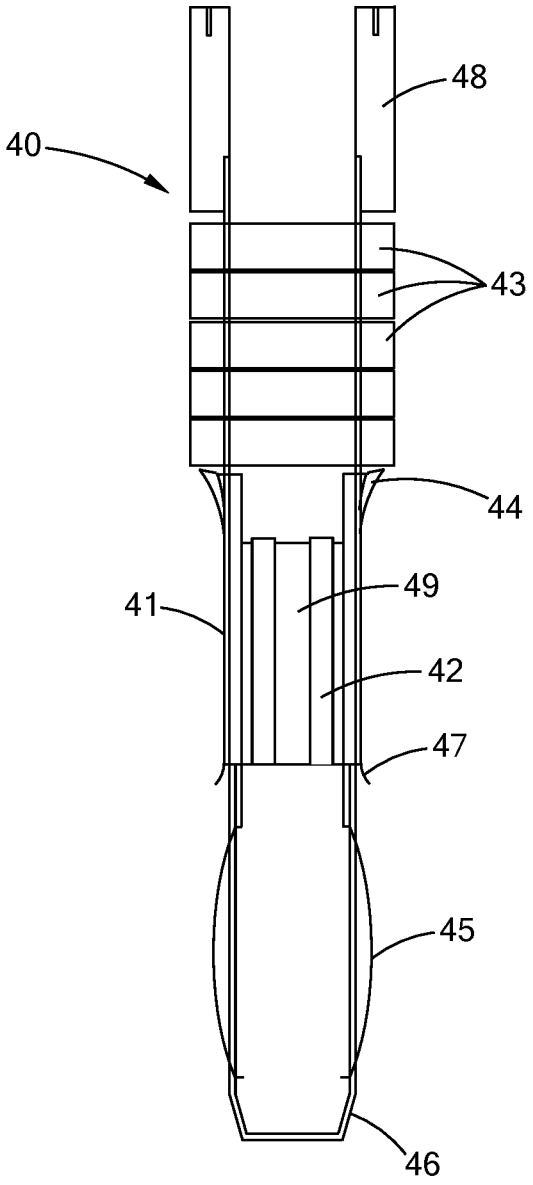
FIG. 5 shows, in cross section, a heater for use in squeezing off perforations in a well.
Figure 7A:
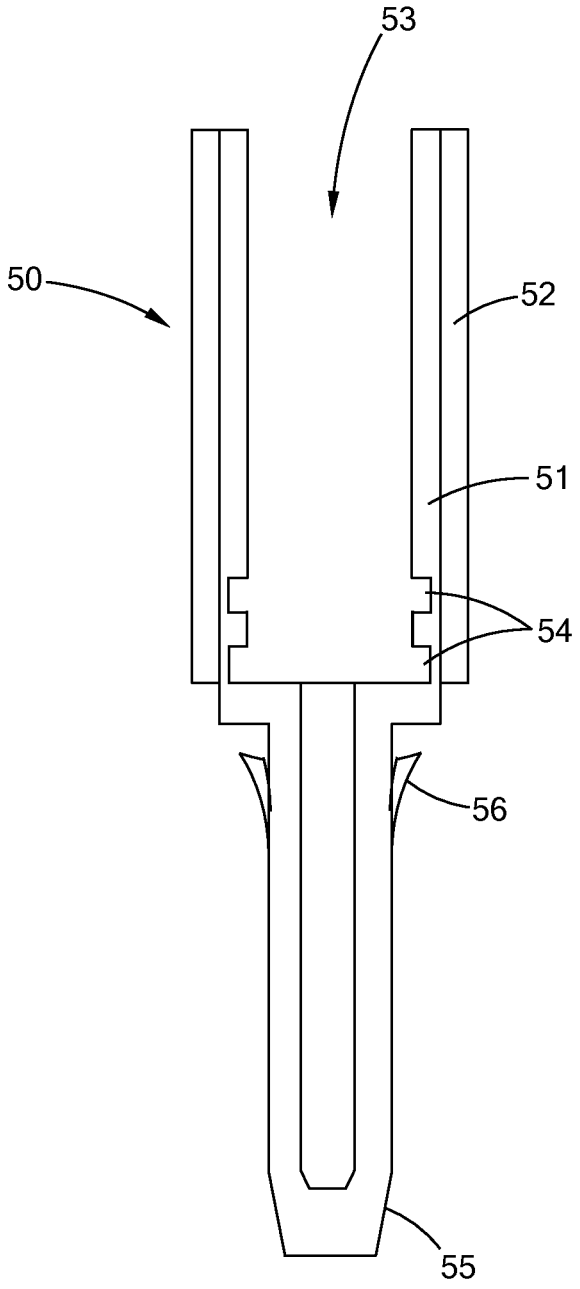
FIG. 7*a* shows, in cross section, a plug for use in squeezing off perforations in a well.
Figure 7B:
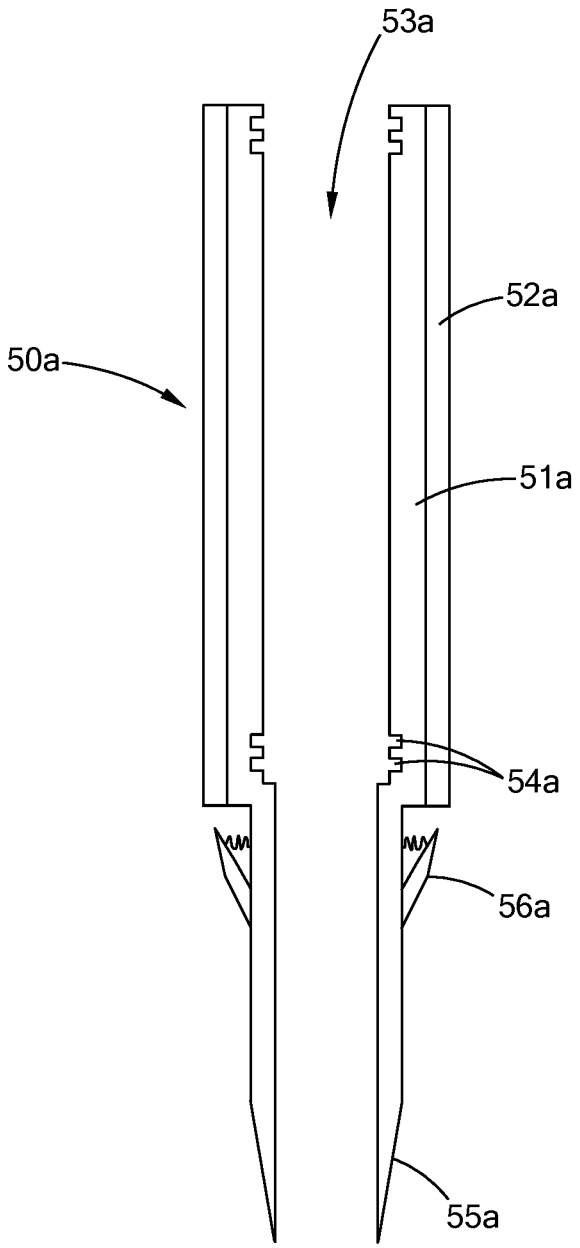
FIG. 7*b* shows, in cross section, an alternative version of a plug for use in squeezing off perforations in a well.

FIGS. 5, 7*a* and 7*b* show preferred embodiments of heater 40 and plug 50, 50*a* respectively that enable the delivery of additional eutectic alloy to plug 1 of the present invention when it is in-situ within a well. In order to distinguish the heater 40 and plug 50, 50*a* from those which have already been described, they will be referred to as a squeezing off heater 40 and squeezing off plug 50, 50*a*. However it is appreciated that such tools could be used for other tasks beyond squeezing off well perforations.

As will be appreciated from FIG. 5 the heater 40 has a heater body 41 which is shaped so as to be receivable within the cavity 4 of a plug of the present invention. As with the other heaters of the present invention a heat source 42, preferably in the form of a cartridge heater, is provided within the heater body. The zinc 49 is provided around the heat source to direct the heat towards the eutectic alloy 43 during the melting process. As already indicated, appropriate alternatives to zinc could also be employed.

Unlike the other heaters described hereinbefore the squeezing off heater 40 is provided with means to receive eutectic alloy 43. In the embodiment shown the alloy 43, which is a Bismuth alloy, is provided in the form of rings that stack around the outside of the heater 40. The rings, which are slideably mounted on the heater 40, are retained in place by a releasable catch 44.

The catch 44 is operated by a release mechanism 45 which is located lower down the heater body 41. When the heater body 41 is inserted into the cavity of a plug 1 the release mechanism is tripped and the catch released thus allowing the alloy 43 to fall down the heater body 41 in to a closer proximity with the heat source 42.

A run-off guard 41 is provided on the heater to prevent any alloy which melted by the heat source 42 from flowing into the gap between the heater 40 and the plug 1.

Also, as with the extraction heater 30 shown in FIG. 3, the squeezing off heater 40 is provided with a tapered end 46 to aid its insertion into the cavity 4 of a plug that is in-situ within a well.

Figures 6A, 6B:
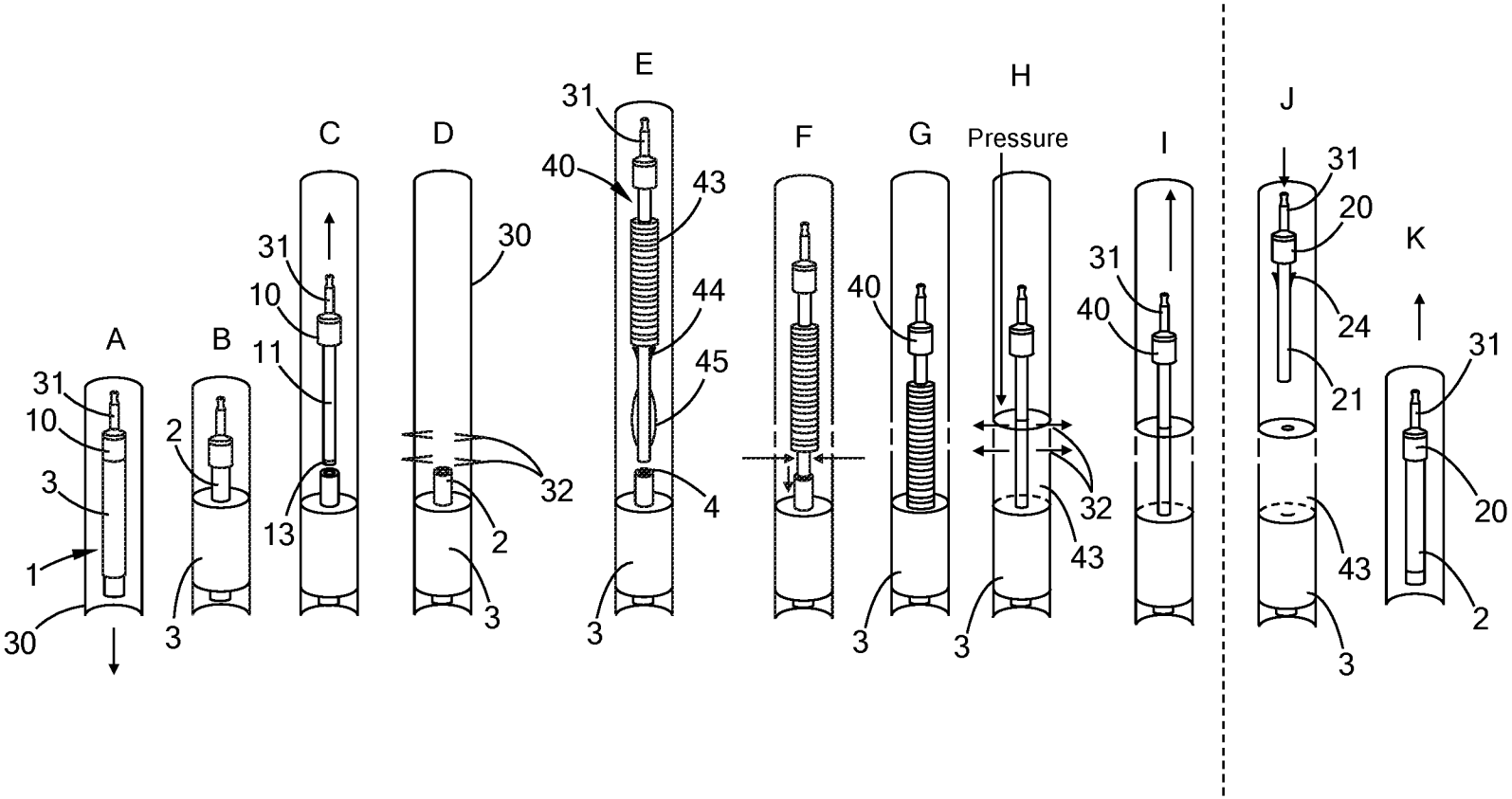
FIG. 6*a* shows the stages involved in using the heater of FIG. 5 to squeeze off perforations within a well.
FIG. 6*b* shows the stages involved in the recovery of the plug deployed in FIG. 6*a;*

The various stages of the deployment of the squeezing off heater 40 can be understood from FIG. 6*a*, whereas the plug extraction process is shown in FIG. 6*b*. Stages A, B & C, show again how a plug is fitted within a well and are as described previously.

It will be appreciated from stage D that the plug 1 is fitted within the well 30 at a location below the perforations 32 so as to facilitate the squeezing off procedure. In stage E the squeezing off heater 40 is delivered into the well using the same delivery method as previously described.

With the aid of its tapered end the heater is inserted in to the cavity 4 of the in-situ plug 1, which in turn releases the alloy to fall into close proximity with the heat source for melting, see stages F and G.

As the alloy 43 melts it slumps down on to the in-situ plug 1. It will be appreciated that the pressure within the well, which is primarily caused by the weight of the water above the location pushing down on the alloy, is such that it will force the alloy into the perforations in the well casing. As before the temperature within the well is such that once the alloy is out of close proximity with the heat source it will begin to cool, solidify and expand, thereby squeezing off the perforations 32. It is appreciated that it may be desirable to artificially increase the pressure within the well to aid the ingress of alloy into the perforations.

Once the heat source has turned off, and the alloy given adequate time to solidify, the heater 40 can be recovered from the well using the delivery tool in the same manner as previously described.

In the event that it becomes necessary to recover the plug from the well 30 the extraction heater 20 can be employed. It will be appreciated that, because the heat source of the extraction heater 20 is focused downwards rather than sideward, it is possible to extract the plug without reopening the sealed well perforations 32.

FIG. 7*a* shows a squeezing off plug 50, which can be used in combination with the standard deployment heater 10, as an alternative to or in combination with the squeezing off heater 40. The plug 50 has a body 51 on which is received the eutectic alloy 52. The plug body 51 also has a cavity 53 with means 54 for releasably retaining the heater 10. The arrangement of the cavity and the means for releasably retaining the heater is similar to that already described in the plug 1 of FIG. 1. Although a means for retaining the extraction heater is not shown in FIG. 7*a* it is anticipated that such might usefully be employed, for which see FIG. 7*b*.

The lower part of the plug body 51 is shaped so as to be receivable within the cavity 4 of an in-situ plug 1. The lower part of the plug body, which has a tapered end 55 to aid insertion, is also provided with a latch mechanism 56 to retain the squeezing off plug within the adjacent plug 1. The latch mechanism 56, which is similar to that already described in connection with the extraction heater 20, enables the adjacent plugs to connect to one another and thus makes it easier to recover the plugs.

FIG. 7*b* show a preferred alternative to the squeezing off plug. Plug 50*a* shares all the features already described in FIG. 7*a* but differs by virtue of the fact that the cavity 53*a* extends through the entire length of the plug 5.0*a* and thereby renders it open at both ends of the plug 50*a*. This arrangement means that a long thin heater can be inserted through to the bottom of the plug 50*a*.

Figures 8A, 8B:
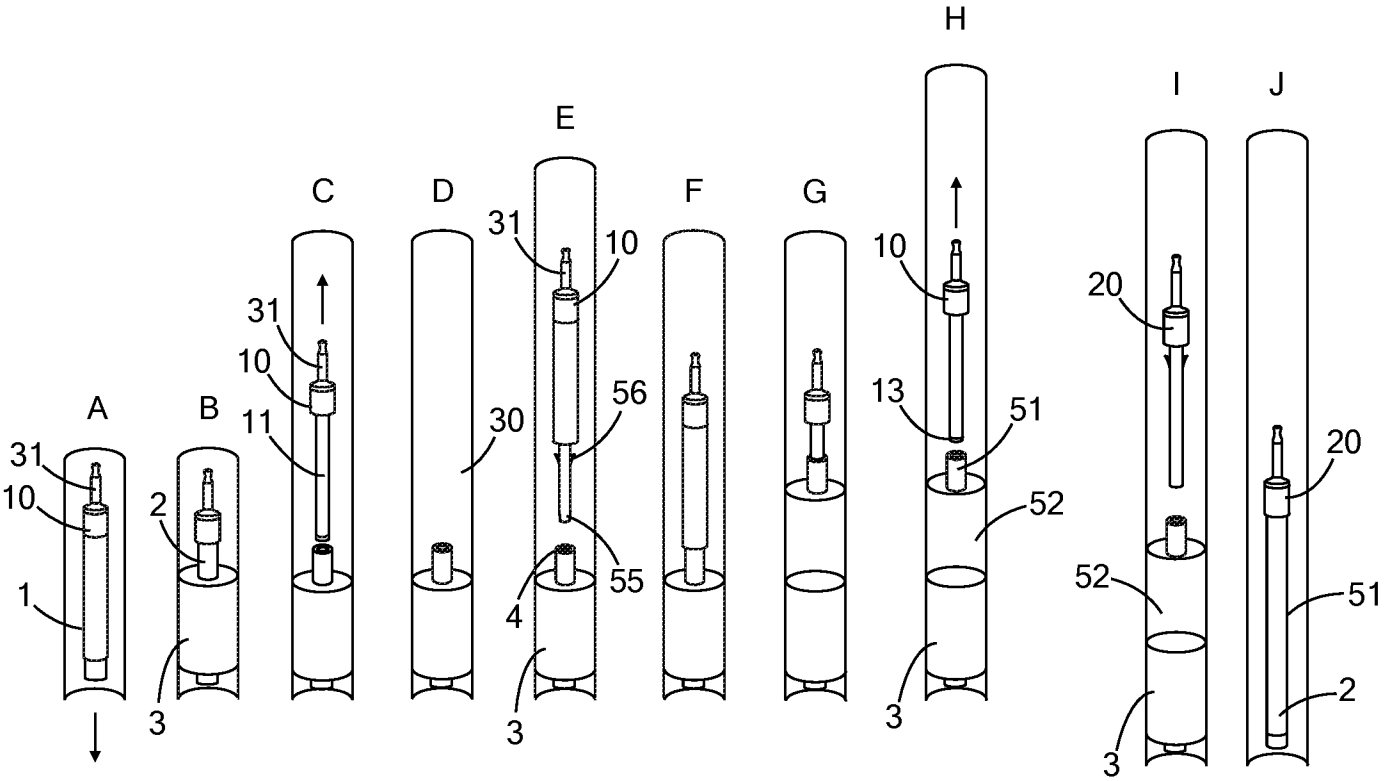
FIG. 8*a* shows the stages involved in using the plug of FIG. 7 to squeeze off perforations within a well.
FIG. 8*b* shows the stages involved in the recovery of the plug deployed in FIG. 8*a;*

FIG. 8*a* shows the squeezing off process using the squeezing off plug 50 on fop of an existing in-situ plug 1 that was deployed by a method of the present invention. FIG. 8*b* shows the recovery of the plugs from the well.

As before, stages A-C show the deployment of a standard plug 1 within a well. Stage D shows that the plug is fitted within the well at a location below the well perforations 32 that are to be squeezed off.

Stage E of FIG. 8*a* shows the deployment of the squeezing off plug/heater assembly into a well which, as before, is carried out using a delivery tool such as a cable and winch (not shown) attached to the heater 10 via the cable head 31.

The tapered end of plug 50 aids the insertion of the plug 50 into the cavity 4 of the in-situ plug 1, see stage E. Once in position the heat source melts the alloy on the outside of the squeezing off plug 50. As mentioned above the environment within the well is such that the alloy passes into the perforations where it cools, solidifies and expands to squeeze off the perforations.

As previously described the alloy is allowed to cool before the heater is recovered from the well using the delivery tool. The squeezing off plug 50 is retained in the well by the interaction of the latch mechanism 56 with the one or more recesses 6 in the plug 1.

The plug extraction process will be readily understood from FIG. 8*b* given the previous explanation of the general extraction process using the extraction heater 20.

The process by which alloy 'slumps' into position as it is melted is does occur mainly due to gravitational forces. Thus in the majority of wells, which have a substantially vertical orientation, the embodiments of the present invention described in relation to FIGS. 1-8*b* are effective. However it is appreciated that further adaptation of the eutectic alloy plug is required for wells that are more horizontal in orientation.

Figure 9:
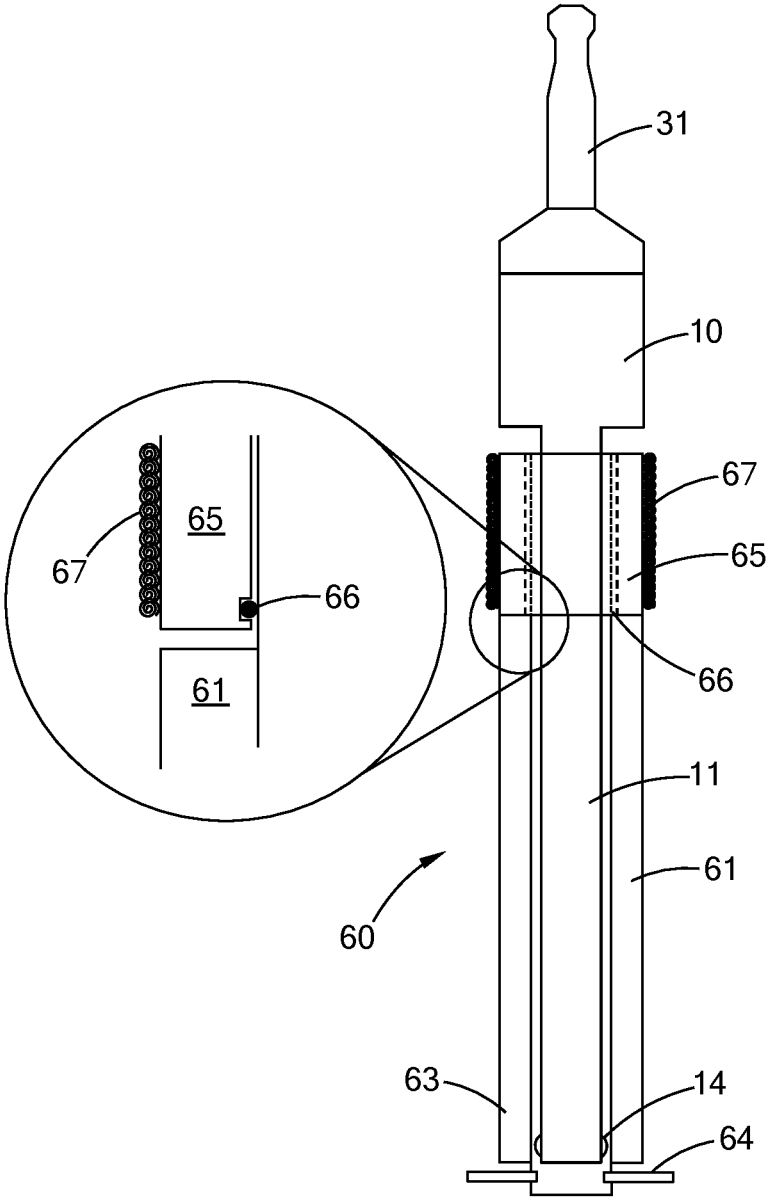
FIG. 9 shows a plug/heater assembly for use primarily in the plugging of non-vertical wells.

FIG. 9 shows a preferred embodiment of a further aspect of the present invention in the form of a horizontal plug 60. The plug 60 is shown connected to the deployment heater 10 which is shown in FIG. 2 without the cable head 31 that is used to attach the heater to a delivery tool.

In addition to the features present on the plug embodiment shown in FIG. 1, the horizontal plug 60 also has a piston-like member at the leading end of the plug 60. The piston-like member, which is preferably provided by a rubber washer 64, is shaped so as form a seal with the well casing. In this way the piston-like member can act like a plunger within the horizontal well.

The plug 60 is also provided with a sliding metal collar 65 which is slideably mounted on the outside of the plug body 62. A rubber seal 66 is located between the metal collar 65 and the plug body 62 to prevent melted alloy from passing through the gap between the collar and the body.

The rubber washer 64 and the rubber seal 66 help contain the melted alloy liquid, as will be described below in connection with process shown in FIG. 10.

A retaining brush or mesh 67 is located on the outer surface of the sliding metal collar 65. When the plug 60 is inserted within a well the brush/mesh makes contact with the well walls.

Figure 10:
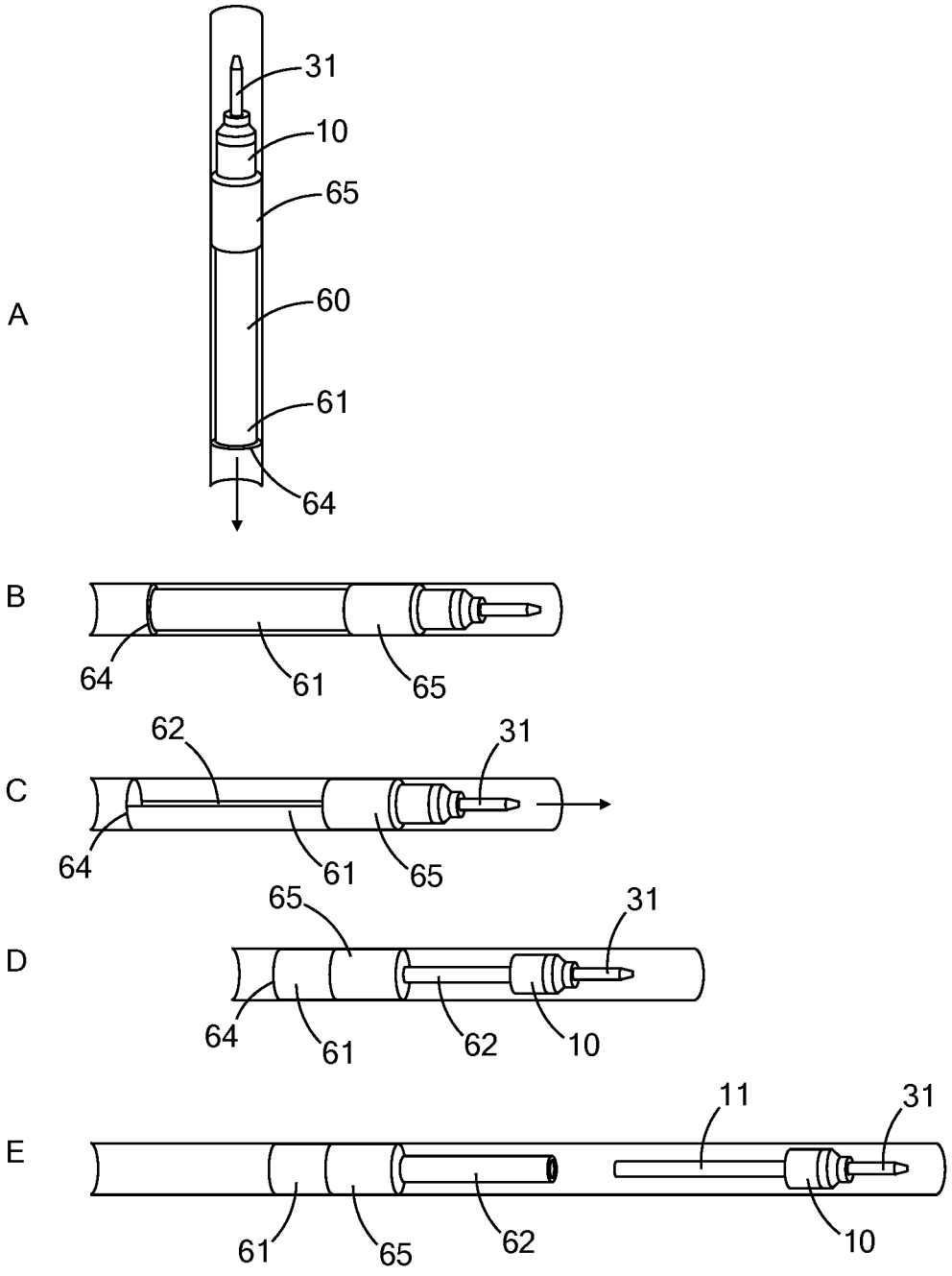
FIG. 10 shows the stages involved in the deployment of a plug within horizontal well using the assembly of FIG. 9.

FIG. 10 shows the stages involved in deploying the horizontal plug 60 within a horizontal well. In stage A the plug 60/heater 10 assembly is lowered into the well on a cable using a delivery tool as previously described. In stage B the assembly is pushed into position using a wireline tractor or pushed into place using the tubing.

Once in position the heater is turned on and the eutectic alloy 61 melted. The alloy 61 is held in place by the washer 64 at the end of the plug 60.

The melted eutectic alloy will flow down and freeze on the metal brush/mesh 67 of the collar 65. It will be appreciated that once the alloy 61 is out of close proximity with the heat source of the heater 10 the alloy will start to cool. This stops the alloy from moving past the collar as well as locking the movable collar in place within the well. This represents stage C of the process.

Once all the alloy has melted, which is usually after about an hour using an electrical heater and between 1-2 minutes using a chemical heater, the delivery tool will be engaged to pull the heater/plug assembly out of the well. It will be appreciated that, because the moveable collar is fixed to the well walls by cooled alloy, the action of pulling the assembly will cause the plug body 62 to be pulled through the movable collar 65. This will drag the washer 64 along, thereby squeezing the liquid alloy up to the movable collar where it will cool and freeze.

It is important that, while the wire mesh 67 will not let the alloy 61 flow past it, water is allowed to escape thus allowing the alloy to be squeezed to form a seal and plug the well, see stage D. The heater 10 will then be turned off allowing the alloy to cool, solidify and expand.

Finally, once the alloy has cooled and the plug 60 has set, the heater 10 will be removed by engaging the delivery tool, As previously described, because the strength with which the plug is sealed in the well by the alloy is stronger that the connection formed between the heater and the plug, the heater is recovered and the plug remains in place within the well.

Figure 11:
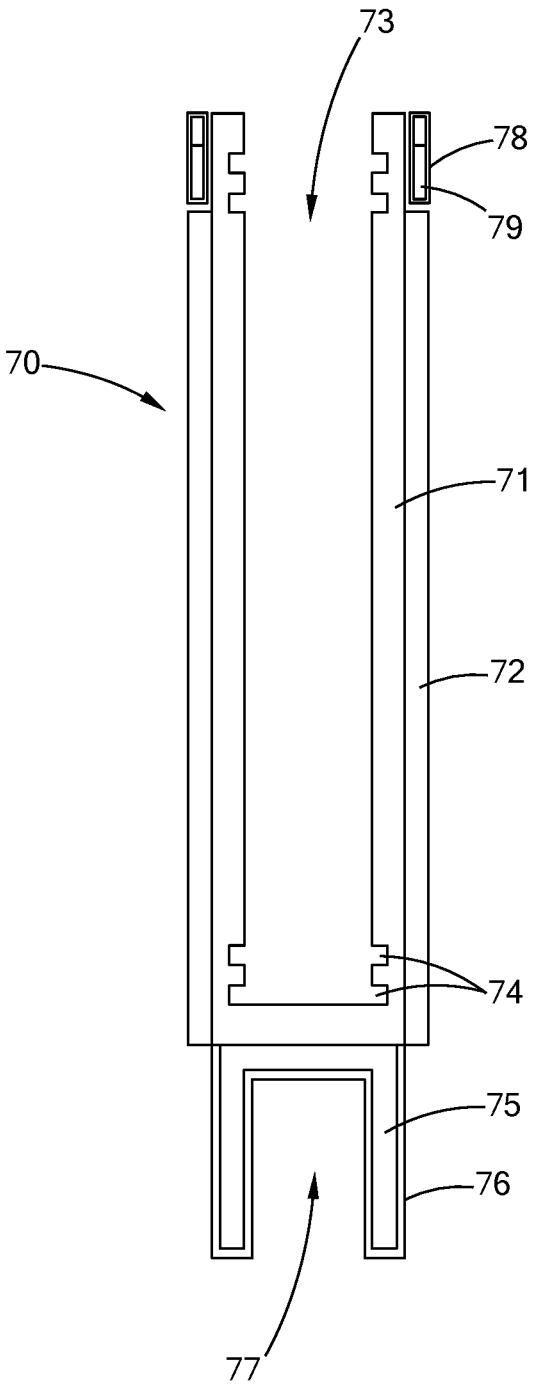
FIG. 11 shows, in cross section, a variant of the plug of FIG. 1.

FIG. 11 shows a further improvement to the retrievable plug of the present invention. The plug shown in FIG. 11, which is called an anti-creep plug 7, has all the same features as the plug 1 shown in FIG. 1. As already described the plug 70 comprises a body 71, which is preferably made of steel, on to the outside of which is received the eutectic alloy 72. The body 71 has a cavity 73 into which a heater can be received. In the internal walls of the body are the recesses 74 that enable the heater to be releasably retained.

At the head of the plug 70, as with the plug of FIG. 1, is an open ended cylinder 75, which is preferably made from steel. The cylinder 75 is covered in a layer of pure bismuth 76 to protect the steel from the acidic gases that can be found in wells, it is appreciated that alternative means for protecting the cylinder might reasonably be employed. The cylinder 75, which has a cavity 77, provides a cooler region where the molten eutectic alloy can cool and solidify to form the seal with the well.

At the top of the plug 70, resting on the eutectic alloy 72, is a hollow steel ring 78, which is filled with a higher density metal 79, such as lead or tungsten, although other high density materials could be considered. When the eutectic alloy melts and slumps down, the steel ring 78 will float semi-submerged in the molten alloy 72. Then, when the heater is turned off and the alloy is allowed to cool, the ring will become embedded in the top of the alloy. It is appreciated that the presence of the ring 78 reduces the eutectic alloys ability to creep, which is important when working on deep wells.

Figure 12:
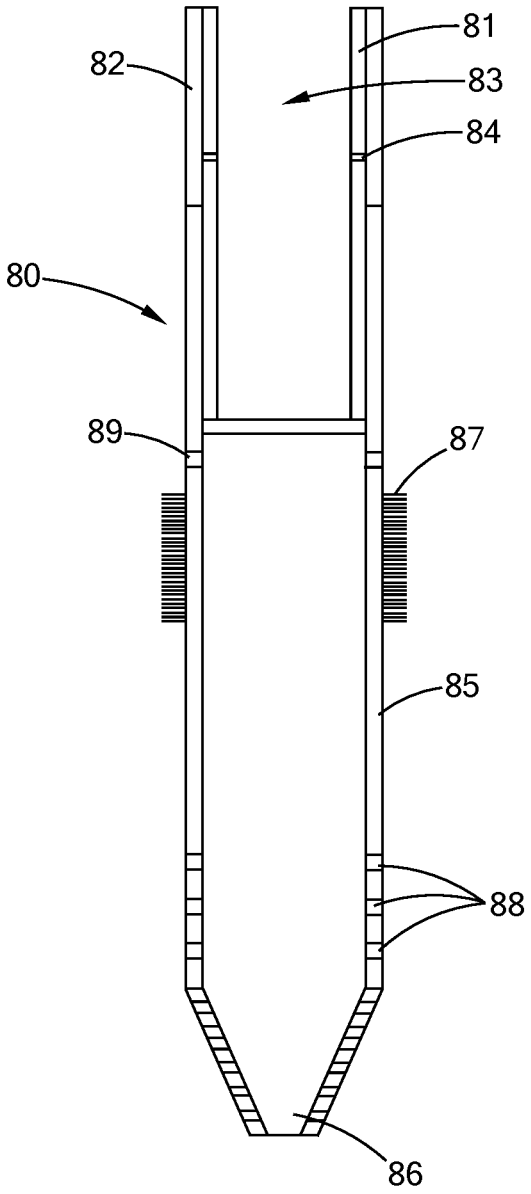
FIG. 12 shows, in cross section, the lower portion of another variant of the plug of FIG. 1.
Figure 13:
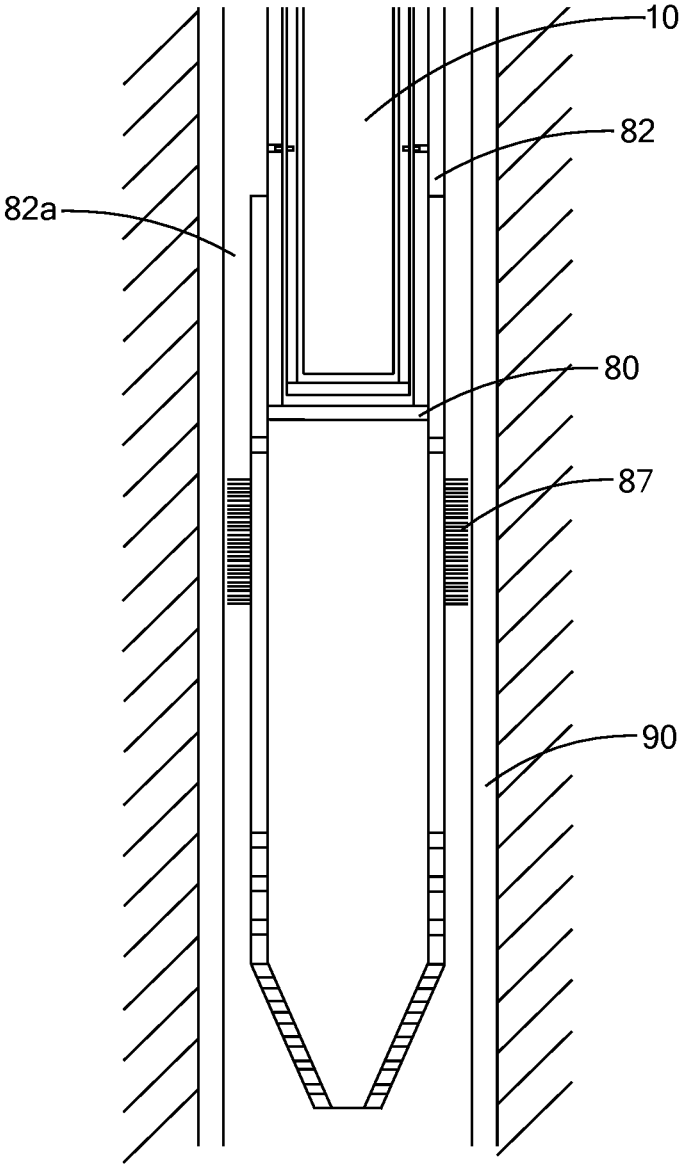
FIG. 13 shows, in cross section, the plug of FIG. 12 within a well casing.

FIGS. 12 and 13 show another preferred improvement to the retrievable plug of the present invention has all the same features as the plug 1 shown in FIG. 1. As already described the plug 80 comprises a body 81, which is preferably made of steel, on to the outside of which is received the eutectic alloy 82. The body 81 has a cavity 83 (both partially shown) into which a heater can be received. In the internal walls of the body are the recesses 84 that enable the heater to be releasably retained, although, as already envisaged above, alternative retaining means may be employed.

At the head of the plug 80, as with the plug of FIG. 1, is an open ended cylinder or skirt 85, which is preferably made from steel and may be coated in bismuth alloy. However in order to aid the deployment of the plug SO down the well the cylinder is tapered at the end. It is appreciated that the extent to which the cylinder tapers may vary from plug to plug.

The tapered leading portion of the cylinder 85 has a main opening 86 and a plurality of smaller openings 88 into an internal cavity in to which water, which is normally present within a well, can flow. In this way the cylinder provides a cooler region where the molten eutectic alloy can cool and solidify to form the seal with the well. The plurality of smaller openings 88 in the cylinder enable the water in the well to circulate through the cylinder 85 and keep it cool.

In order to prevent air being trapped in the cavity as the plug 80 is lowered in to the well the plug 80 is provided with one or more openings 89 that allow air to escape the cavity.

The plug 80 is also preferably provided, although not essentially in combination with the other features shown in FIGS. 12 and 13, with alloy retaining brushes or pads 87. The brushes 87, which are arranged around the circumference of the cylinder 85, extend from the external surface of the cylinder 85 and help to slow the progress of the melted alloy 82A as it trickles down the sides of the cylinder 85. In this way the melted alloy 82A stays in contact with the plug for longer and thus has more time to cool down and solidify.

Although alternative mechanisms could be used to impede the movement of the melted alloy down the sides of the plug it is appreciated that the use of brushes 87 is particularly advantageous as they are flexible and as such do not impede the deployment of the plug 80 down a well. The brushes 87 can also be arranged to provide a cleaning function on the well casing 90 as the plug 80 is deployed.

It is also envisaged that the size of the brushes 87 (e.g. the extent to which they extend from the cylinder) can be varied to suit wells of differing diameter, it is further envisaged that by increasing the size of the brushes 87 it is possible to reduce the diameter of the main body of the plug 80. To this end the brushes 87 are preferably interchangeable. Alternatively the cylinder or skirt 85, having brushes 87 mounted thereon, may itself be interchangeable.

FIG. 13 shows a diagrammatic cross-section of a well easing 90 with the plug 80 in place. The diagram shows both solid alloy 82, which is retained on the sides of the plug 80 while the plug is deployed, and the molten alloy 82A which is formed when the heater is activated. The two forms of alloy 82, 82A are shown as being present at the same time for demonstration purposes only, as it will be appreciated that the heater would melt the alloy on both sides evenly.

Although the preferred embodiments, described herein with reference to the figures, ai! provide a mechanical means for releasably connecting the heater and the plug of the present invention together, it is appreciated that there are alternative ways to form a releasable connection between the heater and the plug, such as electrical (solenoid) or chemical (resin) and other methods deemed suited to purpose. Other mechanical means for releasably connecting the heater and the plug include sheer pins, rubber 'O' rings, and breakable wedges made from metal or plastic.

The invention claimed is:

1. A system for placing a plug in a well, the system comprising:

a. a plug body comprising a surface defining a heater receiving cavity, thereby defining a cavity surface;

b. a heater comprising a surface, wherein the surface is configured to mechanically engage the plug body cavity, whereby the heater surface is adjacent the cavity surface and thereby in thermal contact with the plug body;

c. a eutectic alloy, the eutectic alloy being located adjacent to an outer surface of the plug body, wherein the eutectic alloy is in thermal contact with the plug body;

d. a heater releasable engagement mechanism, positioned within the plug body; and, e. the plug body further comprising a means to freeze molten eutectic alloy, wherein the means to freeze is located below the heater receiving cavity.

2. The system of claim 1, wherein the heater is selected from the group consisting of chemical heaters and electrical heaters.

3. The system of claim 1, wherein the means to freeze molten eutectic alloy is located below the eutectic alloy.

4. A method of making a releasable plug system, the method comprising:

a. releasably engaging a heater comprising a surface, wherein the surface is configured to mechanically engage a plug body defining a cavity, whereby the heater surface is adjacent a cavity surface of the plug body cavity and thereby in thermal contact with the plug body;

b. placing a eutectic alloy adjacent to an outer surface of the plug body, wherein the eutectic allow is in thermal contact with the plug body; and, c. placing on the plug body below the cavity, a means to freeze molten eutectic alloy.

5. The method of claim 4, wherein the heater is selected from the group consisting of chemical heaters and electrical heaters.

6. The method of claim 4, wherein the means to freeze molten eutectic alloy is located below the eutectic alloy.

7. A method for removing a plug from a well, the method comprising:

a. positioning a heater in a section of a well, the section having a plug; the heater comprising a heating element and an outer heater surface;

b. the plug comprising a plug body and an alloy extending from the plug body to an inner surface of the well, the plug body defining a heater receiving cavity, the cavity having a cavity opening and a cavity surface, and wherein the heater mechanically engages the plug;

c. bringing the outer heater surface into thermal contact with the alloy;

d. activating the heating element to melt the alloy, and thereby flowing the molten alloy; and, e. removing the heater assembly and plug body from the well.

* * * * *